US006808570B2

(12) United States Patent
Mitsuhashi

(10) Patent No.: US 6,808,570 B2
(45) Date of Patent: Oct. 26, 2004

(54) FIN AND TUBE FOR HIGH-TEMPERATURE HEAT EXCHANGER

(75) Inventor: Akira Mitsuhashi, Kitamoto (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/382,904

(22) Filed: Mar. 7, 2003

(65) Prior Publication Data

US 2003/0170139 A1 Sep. 11, 2003

(30) Foreign Application Priority Data

Mar. 8, 2002 (JP) ..... 2002-063101

(51) Int. Cl.[7] ..... C22C 19/03; C22C 19/05

(52) U.S. Cl. ..... 148/429; 148/428; 420/445; 420/460; 165/905

(58) Field of Search ..... 148/428, 429; 420/445, 460; 165/905

(56) References Cited

U.S. PATENT DOCUMENTS 4,689,279 A * 8/1987 Hull et al. ..... 428/679
4,765,956 A * 8/1988 Smith et al. ..... 420/445
4,861,550 A * 8/1989 Yoshida et al. ..... 420/460
4,979,995 A * 12/1990 Hattori et al. ..... 148/675

FOREIGN PATENT DOCUMENTS

EP 0 251 295 * 1/1988

OTHER PUBLICATIONS

McCabe et al., Unit Operations of Chemical Engineering, pp. 426 to 428, 1967.*

* cited by examiner

*Primary Examiner*—John P Sheenan
(74) *Attorney, Agent, or Firm*—Oblon, Spivak, McClelland, Maier & Neustadt, P.C

(57) ABSTRACT

A fin and a tube for a high-temperature heat exchanger are made of a nickel-based alloy which contains 2.0 to 5.0% of Al and further contains, as required, at least one selected from the group consisting of 0.1 to 2.5% of Si, 0.8 to 4.0% of Cr, and 0.1 to 1.5% of Mn, the balance being Ni and unavoidable impurities.

16 Claims, No Drawings

FIN AND TUBE FOR HIGH-TEMPERATURE HEAT EXCHANGER

BACKGROUND OF THE INVENTION

1. Field of the Invention

The present invention relates to a fin and to a tube which are used in apparatuses for various high-temperature heat exchange processes, such as the steam reforming processes of fuel cells, recovery of heat from waste gas in solid electrolyte fuel cells, regenerators of micro gas turbines and heat recovery in incinerators (hereinafter generically referred to as a high-temperature heat exchanger).

2. Prior Art

Because all of the steam reforming processes of fuel cells, solid electrolyte fuel cells, regenerators of micro gas turbines, high-temperature incinerators in which the generation of dioxins is minimized, etc., are conducted at high temperatures, it is necessary to install auxiliary equipment to recover or recycle heat after use at high efficiency in order to ensure overall heat efficiency in the overall process. These apparatuses for heat recovery or recycling are auxiliary equipment and, therefore, it is necessary to reduce the size thereof to save space as much as possible. Furthermore, the auxiliary equipment is made of stainless steel or heat-resistant nickel-based alloy which is superior in oxidation resistance at high temperatures, and in particular, fins and tubes in a high-temperature heat exchanger exposed to a high-temperature atmosphere containing a large amount of steam, which has the harshest effects, must be fabricated from materials which are superior in oxidation resistance at high temperatures.

While it is particularly important that materials of fins and tubes in this high-temperature heat exchanger be superior in oxidation resistance at high temperatures, they are required to further combine characteristics such as excellent workability, good thermal conductivity, and excellent solderability or weldability because these materials must be rolled into thin sheets.

Stainless steels, nickel-based alloys, etc., which are superior in corrosion resistance at high temperatures are used as the materials for fins and tubes in this high-temperature heat exchanger. It is known that, for example, the following materials are used: a steel sheet for a heat exchanger which is superior in workability and oxidation resistance at high temperatures and which contains, by mass % (hereinafter "%" indicates "mass %"), not more than 0.015% of C, not more than 0.50% of Si, 0.05 to 0.40% of Mn, not more than 0.030% of P, not more than 0.010% of S, 0.50 to 5.0% of Cr, 0.03 to 0.20% of Ti, 0.0003 to 0.0015% of B, not more than 0.0060% of N, and the balance Fe and unavoidable impurities (refer to the Japanese Patent Laid-Open No. 63-230853), a nickel-based alloy which is superior in corrosion resistance at high temperatures which contains not more than 0.05% of C, 1.5 to 4.5% of Si, not more than 1.0% of Mn, not more than 0.03% of P, not more than 0.03% of S, 35.0 to 75.0% of Ni and 12.0 to 25.0% of Cr, with Ni and Si so as to fulfill the relationship $3Ni \geqq 105 + 20Si$, and the balance Fe and unavoidable impurities (refer to Japanese Patent Laid-Open No. 3-100134), etc.

However, because fins and tubes fabricated from such stainless steels have insufficient oxidation resistance in high-temperature, high-concentration steam atmospheres, it is desirable that fins and tubes in a high-temperature heat exchanger as described above be fabricated from a nickel-based alloy having better oxidation resistance at high temperatures. On the other hand, although fins and tubes fabricated from the above-described conventional nickel-based alloy is superior in corrosion resistance at high temperatures, its workability is not sufficient, and furthermore, a high-temperature heat exchanger provided with fins and tubes made of the above-described conventional nickel-based alloy has a problem in that the heat exchange efficiency decreases with increasing period of service.

SUMMARY OF THE INVENTION

Therefore, the inventors conducted research in order to clarify the causes of the above, and the following results were obtained.

(a) In a high-temperature heat exchanger incorporating fins and tubes made of the above-described conventional nickel-base alloy which is superior in oxidation resistance at high temperatures, oxide scale having lower thermal conductivity is likely to form on the surfaces of the fins and tubes when the high-temperature heat exchanger is used for a long period of time. When adhering oxide scale having lower thermal conductivity forms a thick layer on the surfaces of the fins and tubes, the heat exchange efficiency of the heat exchanger decreases.

(b) However, among conventionally known heat-resistant nickel-based alloys, a nickel-based alloy containing 2.0 to 5.0% of Al and the balance Ni and unavoidable impurities (hereinafter referred to as an Al-containing nickel-based alloy) is superior in oxidation resistance at high temperatures and strength at high temperatures and has excellent thermal conductivity and plastic workability, and furthermore, oxide scale is less likely to form on the surface of this Al-containing nickel-based alloy. Therefore, oxide scale does not form a thick layer on the surfaces of fins and tubes made of this Al-containing nickel-based alloy and, therefore, the decrease in heat exchange efficiency is minimal even when a high-temperature heat exchanger using fins and tubes formed from this Al-containing nickel-based alloy is used for a long period of time.

(c) Strength at high temperatures and oxidation resistance at high temperatures are further improved in an Al-containing nickel-based alloy which contains 2.0 to 5.0% of Al and further contains as required one or more selected from the group consisting of 0.1 to 2.5% of Si, 0.8 to 4.0% of Cr and 0.1 to 1.5% of Mn, and the balance being Ni and unavoidable impurities.

The present invention was made on the basis of the above-described results of the research and has the following features.

(1) a fin for a high-temperature heat exchanger formed from a nickel-based alloy containing 2.0 to 5.0% of Al, the balance being Ni and unavoidable impurities;

(2) a tube for a high-temperature heat exchanger formed from a nickel-based alloy containing 2.0 to 5.0% of Al, the balance being Ni and unavoidable impurities;

(3) a fin for a high-temperature heat exchanger formed from a nickel-base alloy containing 2.0 to 5.0% of Al, and further containing one or more selected from the group consisting of 0.1 to 2.5% of Si, 0.8 to 4.0% of Cr and 0.1 to 1.5% of Mn, the balance being Ni and unavoidable impurities; and (4) a tube for a high-temperature heat exchanger formed from a nickel-based alloy containing 2.0 to 5.0% of Al, and further containing one or more selected from the group consisting of 0.1 to 2.5% of Si, 0.8 to 4.0% of Cr and 0.1 to 1.5% of Mn, the balance being Ni and unavoidable impurities.

Next, the reasons for the above-described limitations on the chemical compositions of the nickel-based alloy from which the fin and tube for a heat exchanger of the invention are formed will be described below.

(a) Al

Al forms an alumina film on the surface of the nickel-based alloy and the rates of formation of oxide scale are low on the fin and in the tube for a heat exchanger fabricated from this nickel-based alloy, with the result that decreases in the heat exchange efficiency of the heat exchanger are small even when the heat exchanger is used for a long period of time. However, if the Al content is less than 2.0%, an adequate alumina film is not formed, and hence the desired effects cannot be obtained. On the other hand, if the Al content exceeds 5.0%, hot workability decreases because of the precipitation of the γ' phase (an $Ni_3Al$ intermetallic compound) on the matrix, and working becomes difficult. Thus, these Al components are undesirable. Accordingly, the specified Al content is in the range of 2.0 to 5.0% and preferably in the range of 3.6 to 4.4%.

(b) Si

Si, which has the function of improving oxidation resistance at high temperatures, is added as required. However, if the Si content is less than 0.1%, the desired effect of the above-described function cannot be obtained. On the other hand, if the Si content exceeds 2.5%, cracks are likely to occur during hot working. Accordingly, the specified Si content is in the range of 0.1 to 2.5% and preferably in the range of 1.2 to 1.8%.

(c) Cr

Cr, which has the function of improving heat resistance, is added as required. However, if the Cr content is less than 0.8%, the desired effect of the above-described function cannot be obtained, especially in a high-temperature combustion gas atmosphere at or above 1,000° C. On the other hand, if the Cr content exceeds 4.0%, strength at high temperatures decreases. Accordingly, the specified Cr content is in the range of 0.9 to 2.5% and preferably in the range of 1.6 to 2.3%.

(d) Mn

Mn, which has the function of improving strength at high temperatures, is added as required. However, if the Mn content is less than 0.1%, the desired effect of the above-described function cannot be obtained. On the other hand, if the Mn content exceeds 1.5%, oxidation resistance at high temperatures decreases. Accordingly, the specified Mn content is in the range of 0.1 to 1.5% and preferably in the range of 0.2 to 0.8%.

DETAILED DESCRIPTION OF THE PREFERRED EMBODIMENTS

The fin and tube for a heat exchanger of the invention will now be described in greater detail by means of examples.

Raw materials were mixed in prescribed proportions, the mixture was vacuum melted in a high-frequency vacuum melting furnace, the melt was vacuum cast to an ingot 120 mm in diameter, and a plate-like body 25 mm in thickness and 120 mm in width was fabricated by hot forging this ingot in conditions of heating to 1,200° C. A hot rolled strip 3 mm in thickness and 120 mm in width was obtained by further hot rolling this hot forged plate-like body at a temperature of 1,200° C., this hot rolled strip was subjected to heat treatment involving quenching from 1,200° C., oxide scale was removed after that, and cold rolling was then performed. By repeating this operation, a sheet 0.5 mm in thickness was eventually fabricated. This sheet 0.5 mm in thickness was cut to a size 100 mm long and 100 mm wide, and the cut sheet was subjected to annealing which involves quenching after heating to 850° C. in a vacuum. In this manner test pieces of the invention 1 to 10 and comparative test pieces 1 and 2 which are made of nickel-based alloys having the chemical compositions shown in Table 1 were fabricated.

Furthermore, a commercial nickel-based alloy sheet containing 16.88% of Cr, 2.86% of Si and 21.1% of Fe and the balance Ni and unavoidable impurities and having a thickness of 0.5 mm was prepared, and a conventional test piece was prepared by cutting this nickel-based alloy sheet to a size 100 mm long and 100 mm wide. The following test was carried out by use of these test pieces of the invention 1 to 10, the comparative test pieces 1 and 2 and the conventional test piece.

EXAMPLES

Oxidation Resistance Test

The test pieces of the invention 1 to 10, the comparative test pieces 1 and 2, and the conventional test piece were held at 970° C. for 400 hours in a high-temperature steam atmosphere having a composition consisting of 50% of steam, 10% of carbon dioxide, 32% of nitrogen and 8% oxygen. After that, photographs of microstructures of each section of the test pieces of the invention 1 to 10, the comparative test pieces 1 and 2, and the conventional test piece were taken at 400× magnification. The maximum thickness of oxide scale formed on the alloy surface was measured from the photographs of microstructures and the difficulty with which oxide scale formed, i.e., the sustainability of high heat exchange efficiency, was evaluated by the results of the measurements shown in Table 1. Furthermore, the maximum depth of erosion (the distance from the front surface of a test piece to the leading end of an internal oxidized part) from the above-described photographs of microstructures, was measured and oxidation resistance at high temperatures was evaluated by showing the results of the measurement in Table 1.

Workability Test

The depths of indentations leading to the occurrence of cracks (hereinafter referred to as the depth of indentations to cracking) was measured in the test pieces of the invention 1 to 10, the comparative test pieces 1 and 2, and the conventional test piece by the Erichsen cupping test (Method A) in accordance with JIS Z2247, and plastic workability necessary for the working to form a tube was evaluated by the results of the measurements shown in Table 1.

TABLE 1

| Test piece | Chemical composition (mass %) Al | Si | Cr | Mn | Ni and unavoidable impurities | Maximum thickness of oxide scale (μm) | Maximum erosion depth (μm) | Depth of indentation to cracking by Erichsen cupping test (mm) |
|---|---|---|---|---|---|---|---|---|
| The invention | | | | | | | | |
| 1 | 2.6 | — | — | — | Balance | 14 | 24 | >15 |
| 2 | 3.8 | — | — | — | Balance | 10 | 19 | >15 |
| 3 | 4.6 | — | — | — | Balance | 8 | 10 | >15 |
| 4 | 3.9 | 2.3 | — | — | Balance | 7 | 9 | >15 |
| 5 | 4.1 | — | 1.7 | — | Balance | 9 | 19 | >15 |
| 6 | 4.2 | — | — | 0.2 | Balance | 10 | 20 | >15 |
| 7 | 4.2 | 0.2 | 2.4 | — | Balance | 9 | 18 | >15 |
| 8 | 4.1 | 1.7 | — | 1.1 | Balance | 13 | 18 | >15 |
| 9 | 4.3 | — | 2.2 | 0.8 | Balance | 12 | 20 | >15 |
| 10 | 4.2 | 1.5 | 1.9 | 0.5 | Balance | 11 | 17 | >15 |
| Comparative example | | | | | | | | |
| 1 | *1.5 | — | — | — | Balance | 27 | 51 | >15 |
| 2 | *5.5 | — | — | — | Balance | 7 | 16 | 10.8 |
| Conventional | Cr: 16.8%, Si: 2.8%, Fe: 21.1% | | | | Balance | 86 | 144 | 11.4 |

(The symbol * denotes values deviating from the ranges of the invention.)

From the results shown in Table 1, it is apparent that in the test pieces of the invention 1 to 10, the maximum thickness of oxide scale formed on the surface is small compared with that formed on the conventional test piece. Therefore, a heat exchanger for the heat recovery of a solid electrolyte fuel cell incorporating the fin and tube of the invention shows a smaller decrease in heat exchange efficiency compared with a heat exchanger incorporating a conventional fin and tube even after use for a long period of time, while for oxidation resistance at high temperatures, it is possible to maintain a conventional level. Furthermore, because the test pieces of the invention 1 to 10 are much superior to the conventional test pieces in workability, small tubes which are more complex can be fabricated, and it is apparent that these tubes are desirable as tubes for a small heat exchangers.

As described above, a high-temperature heat exchanger using the fin and tube of the invention can maintain heat exchange efficiency for a long period of time and have effects which are industrially superior.

What is claimed is:

1. A fin for a high-temperature heat exchanger made of a nickel-based alloy which comprises, by mass %, 2.0 to 5.0% of Al and comprises at least one element selected from the group consisting of 0.1 to 2.5% of Si, 0.8 to 4.0% of Cr and 0.1 to 1.5% of Mn, the balance being Ni and unavoidable impurities.

2. A tube for a high-temperature heat exchanger made of a nickel-based alloy which comprises, by mass %, 2.0 to 5.0% of Al and comprises at least one element selected from the group consisting of 0.1 to 2.5% of Si, 0.8 to 4.0% of Cr and 0.1 to 1.5% of Mn, the balance being Ni and unavoidable impurities.

3. The fin as claimed in claim 1, wherein said fin comprises, by mass %, 2.0 to 5.0% of Al and 0.1 to 2.5% of Si, the balance being Ni and unavoidable impurities.

4. The fin as claimed in claim 1, wherein said fin comprises, by mass %, 2.0 to 5.0% of Al and 0.8 to 4.0% of Cr, the balance being Ni and unavoidable impurities.

5. The fin as claimed in claim 1, wherein said fin comprises, by mass %, 2.0 to 5.0% of Al and 0.1 to 1.5% of Mn, the balance being Ni and unavoidable impurities.

6. The fin as claimed in claim 1, wherein said fin comprises, by mass %, 2.0 to 5.0% of Al, 0.1 to 2.5% of Si, and 0.8 to 4.0% of Cr, the balance being Ni and unavoidable impurities.

7. The fin as claimed in claim 1, wherein said fin comprises, by mass %, 2.0 to 5.0% of Al, 0.1 to 2.5% of Si, and 0.1 to 1.5% of Mn, the balance being Ni and unavoidable impurities.

8. The fin as claimed in claim 1, wherein said fin comprises, by mass %, 2.0 to 5.0% of Al, 0.8 to 4.0% of Cr, and 0.1 to 1.5% of Mn, the balance being Ni and unavoidable impurities.

9. The fin as claimed in claim 1, wherein said fin comprises, by mass %, 2.0 to 5.0% of Al, 0.1 to 2.5% of Si, 0.8 to 4.0% of Cr, and 0.1 to 1.5% of Mn, the balance being Ni and unavoidable impurities.

10. The tube as claimed in claim 2, wherein said tube comprises, by mass %, 2.0 to 5.0% of Al and 0.1 to 2.5% of Si, the balance being Ni and unavoidable impurities.

11. The tube as claimed in claim 2, wherein said tube comprises, by mass %, 2.0 to 5.0% of Al and 0.8 to 4.0% of Cr, the balance being Ni and unavoidable impurities.

12. The tube as claimed in claim 2, wherein said tube comprises, by mass %, 2.0 to 5.0% of Al and 0.1 to 1.5% of Mn, the balance being Ni and unavoidable impurities.

13. The tube as claimed in claim 2, wherein said tube comprises, by mass %, 2.0 to 5.0% of Al, 0.1 to 2.5% of Si, and 0.8 to 4.0% of Cr, the balance being Ni and unavoidable impurities.

14. The tube as claimed in claim 2, wherein said tube comprises, by mass %, 2.0 to 5.0% of Al, 0.1 to 2.5% of Si, and 0.1 to 1.5% of Mn, the balance being Ni and unavoidable impurities.

15. The tube as claimed in claim 2, wherein said tube comprises, by mass %, 2.0 to 5.0% of Al, 0.8 to 4.0% of Cr, and 0.1 to 1.5% of Mn, the balance being Ni and unavoidable impurities.

16. The tube as claimed in claim 2, wherein said tube comprises, by mass %, 2.0 to 5.0% of Al, 0.1 to 2.5% of Si, 0.8 to 4.0% of Cr, and 0.1 to 1.5% of Mn, the balance being Ni and unavoidable impurities.

* * * * *